US010250972B2

(12) United States Patent
Sheerin et al.

(10) Patent No.: US 10,250,972 B2
(45) Date of Patent: Apr. 2, 2019

(54) PHASE PLUG HAVING NON-ROUND FACE PROFILE

(71) Applicant: Apple Inc., Cupertino, CA (US)

(72) Inventors: John H. Sheerin, Santa Clara, CA (US); Ethan L. Huwe, Davis, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/468,030

(22) Filed: Mar. 23, 2017

(65) Prior Publication Data

US 2018/0279041 A1 Sep. 27, 2018

(51) Int. Cl.
*H04R 1/34* (2006.01)
*H04R 1/30* (2006.01)

(52) U.S. Cl.
CPC ..... *H04R 1/347* (2013.01); *H04R 1/30* (2013.01); *H04R 2201/34* (2013.01)

(58) Field of Classification Search
CPC ..... H04R 1/30; H04R 1/345; H04R 1/347; H04R 2400/13; H04R 2201/34; G10K 11/025; G10K 11/28
See application file for complete search history.

(56) References Cited

U.S. PATENT DOCUMENTS 4,050,541 A * 9/1977 Henricksen ..... H04R 1/30 181/159
4,157,741 A 6/1979 Goldwater
4,325,456 A * 4/1982 Ureda ..... G10K 11/025 181/159
4,685,532 A * 8/1987 Gunness ..... G10K 11/025 181/185
6,064,745 A * 5/2000 Avera ..... H04R 1/30 181/152
6,744,899 B1 6/2004 Grunberg
7,095,868 B2 8/2006 Geddes
8,036,408 B2 * 10/2011 Voishvillo ..... H04R 1/30 381/340
8,121,330 B2 * 2/2012 Dodd ..... H04R 1/24 381/337
8,477,979 B2 * 7/2013 O'Neill ..... H04R 9/02 381/339
8,649,544 B2 2/2014 Voishvillo
8,672,088 B2 3/2014 Sterling et al.
9,008,343 B2 * 4/2015 Dimitrov ..... H04R 1/323 181/177
9,264,789 B2 * 2/2016 Donarski ..... G10K 11/025
2008/0264717 A1 * 10/2008 Onishi ..... H04R 1/323 181/192
2012/0033841 A1 * 2/2012 Donarski ..... G10K 11/025 381/340

(Continued)

*Primary Examiner* — Joshua Kaufman
(74) *Attorney, Agent, or Firm* — Womble Bond Dickinson (US) LLP

(57) ABSTRACT

A phase plug having an input face circumscribed by a round profile and an output face circumscribed by a non-round profile, is described. The phase plug may include several arms radiating from a central axis and separated by radial channels extending axially from the input face to the output face. Planes containing the round profile and the non-round profile may be nonparallel, and sound ports at the output face may be asymmetrically disposed about a midline of the output face. Other embodiments are also described and claimed.

20 Claims, 9 Drawing Sheets

(56) References Cited

U.S. PATENT DOCUMENTS

| | | | | |
|---|---|---|---|---|
| 2012/0033842 | A1* | 2/2012 | Donarski | G10K 11/025 381/340 |
| 2013/0182879 | A1* | 7/2013 | Graber | H04R 1/345 381/343 |
| 2013/0243232 | A1* | 9/2013 | Dimitrov | H04R 1/323 381/340 |
| 2018/0091901 | A1* | 3/2018 | Stanley | H04R 1/025 |

* cited by examiner

DETAIL A

PHASE PLUG HAVING NON-ROUND FACE PROFILE

BACKGROUND

Field

Embodiments related to loudspeakers, are disclosed. More particularly, embodiments related to loudspeakers having phase plugs, are disclosed.

Background Information

Loudspeakers, e.g., horn loudspeaker, can include a speaker diaphragm to radiate sound into a throat of an acoustic horn. The acoustic horn transmits the sound along an enlarging horn volume from the throat to a mouth, and radiates the sound efficiently from the mouth into a surrounding environment. A phase plug is used to direct sound waves from the diaphragm to the throat. A device that contains a phase plug between a diaphragm and an exit of the device is commonly known as a compression driver. In the context of compression drivers, a phase plug may be placed between the speaker diaphragm and the throat. Slots in the phase plug direct sound from an input side, i.e., at the radiating surface of the diaphragm. The slots are shaped to recombine the radiated sound in phase at an output side, i.e., at the throat. Circumferential-type phase plugs have annular slots that extend circumferentially around a central axis. The radiating diaphragm and the receiving throat are typically circular. Accordingly, the phase plug typically has an input side and an output side that both include circular profiles to match the adjacent diaphragm and throat geometries.

SUMMARY

Phase plugs having circular profiles at both an input side and an output side function when used in loudspeakers having conventional acoustic horns. More particularly, when the acoustic horn has a circular cross-sectional area at a throat that transitions gradually from the throat to a circular or non-circular cross-sectional area at a mouth, then a circular output side of a phase plug may match the acoustic horn. If the acoustic horn had a specialized geometry, however, a typical phase plug may not adequately match the acoustic horn. For example, if an acoustic horn has a sharp bend between a throat and a mouth, the throat could have a non-circular cross-sectional area, and a circular-output phase plug may not match the acoustic horn.

In an embodiment, a loudspeaker includes a phase plug between a diaphragm of a speaker driver and a throat of an acoustic horn. The phase plug conforms to the geometry of the diaphragm and the throat, and thus, an input face of the phase plug adjacent to the diaphragm may have a geometry different than an output face of the phase plug adjacent to the throat. More particularly, the input face may have a round profile extending around a central axis, and the output face may have a non-round profile extending around the central axis. The round profile may match a shape of the diaphragm, and the non-round profile may match a shape of the throat. For example, the round profile may be circular to match a circular diaphragm, and the non-round profile may be rectangular to match a rectangular throat. The phase plug may have several arms separated from each other by intervening radial channels. That is, the radial channels may extend axially from the input face to the output face between adjacent arms to carry sound from the diaphragm to the horn throat.

The arms of the phase plug may extend radially from a central hub disposed along the central axis, and each arm may have a radially-facing outer surface. In an embodiment, at least one of the outer surfaces includes a portion of the input face and the output face, and the outer surface transitions in an axial direction from a smooth curve at the round profile of the input face to an angle at the non-round profile of the output face. Similarly, the outer surface may transition in the axial direction from a smooth contour surface to an angled contour surface having a ridge.

In an embodiment, the input face and the output face are oriented to conform to an angle of the diaphragm and the throat relative to the central axis. For example, the central axis may be orthogonal to a radiating surface of the diaphragm and oblique to a throat plane. A distal plane containing the non-round profile circumscribing the output face may be tilted to be parallel to the throat plane, and a proximal plane containing the round profile circumscribing the input face may be parallel to the radiating surface. Thus, the distal plane containing the profile of the output face may not be parallel to the proximal plane containing the profile of the input face. The asymmetry in the phase plug geometry may allow the phase plug to conform to adjacent loudspeaker components.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

DETAILED DESCRIPTION

Embodiments describe a phase plug having an input face circumscribed by a round profile and an output face circumscribed by a non-round profile. The phase plug may be a component of a loudspeaker used in a consumer electronics device, such as a desktop computer, a laptop computer, a tablet computer, a mobile device, a wearable computer, or a loudspeaker system. The phase plug may, however, be incorporated into other devices and apparatuses, such as a medical device or a motor vehicle, to name only a few possible applications.

In various embodiments, description is made with reference to the figures. However, certain embodiments may be practiced without one or more of these specific details, or in combination with other known methods and configurations. In the following description, numerous specific details are set forth, such as specific configurations, dimensions, and processes, in order to provide a thorough understanding of the embodiments. In other instances, well-known processes and manufacturing techniques have not been described in particular detail in order to not unnecessarily obscure the description. Reference throughout this specification to "one embodiment," "an embodiment," or the like, means that a particular feature, structure, configuration, or characteristic described is included in at least one embodiment. Thus, the appearance of the phrase "one embodiment," "an embodiment," or the like, in various places throughout this specification are not necessarily referring to the same embodiment. Furthermore, the particular features, structures, configurations, or characteristics may be combined in any suitable manner in one or more embodiments.

The use of relative terms throughout the description may denote a relative position or direction. For example, "in front of" may indicate a first direction away from a reference point. Similarly, "behind" may indicate a location in a second direction orthogonal to the first direction. Such terms are provided to establish relative frames of reference, however, and are not intended to limit the use or orientation of a phase plug to a specific configuration described in the various embodiments below.

In an aspect, a phase plug includes a first face, e.g., an input face, circumscribed by a round profile, and a second face, e.g., an output face, circumscribed by a non-round profile. The phase plug may have an envelope defined by radiating arms and radially oriented slots. A lateral surface of the envelope can transition from the input face to the output face. More particularly, outer surfaces of the arms can transition from a smooth curve at the input face to an angled edge at the output face. Accordingly, the phase plug can transition between a round input face to a rectangular output face. The input face can conform to a loudspeaker diaphragm and the output face can conform to a throat of a loudspeaker horn.

Figure 1:
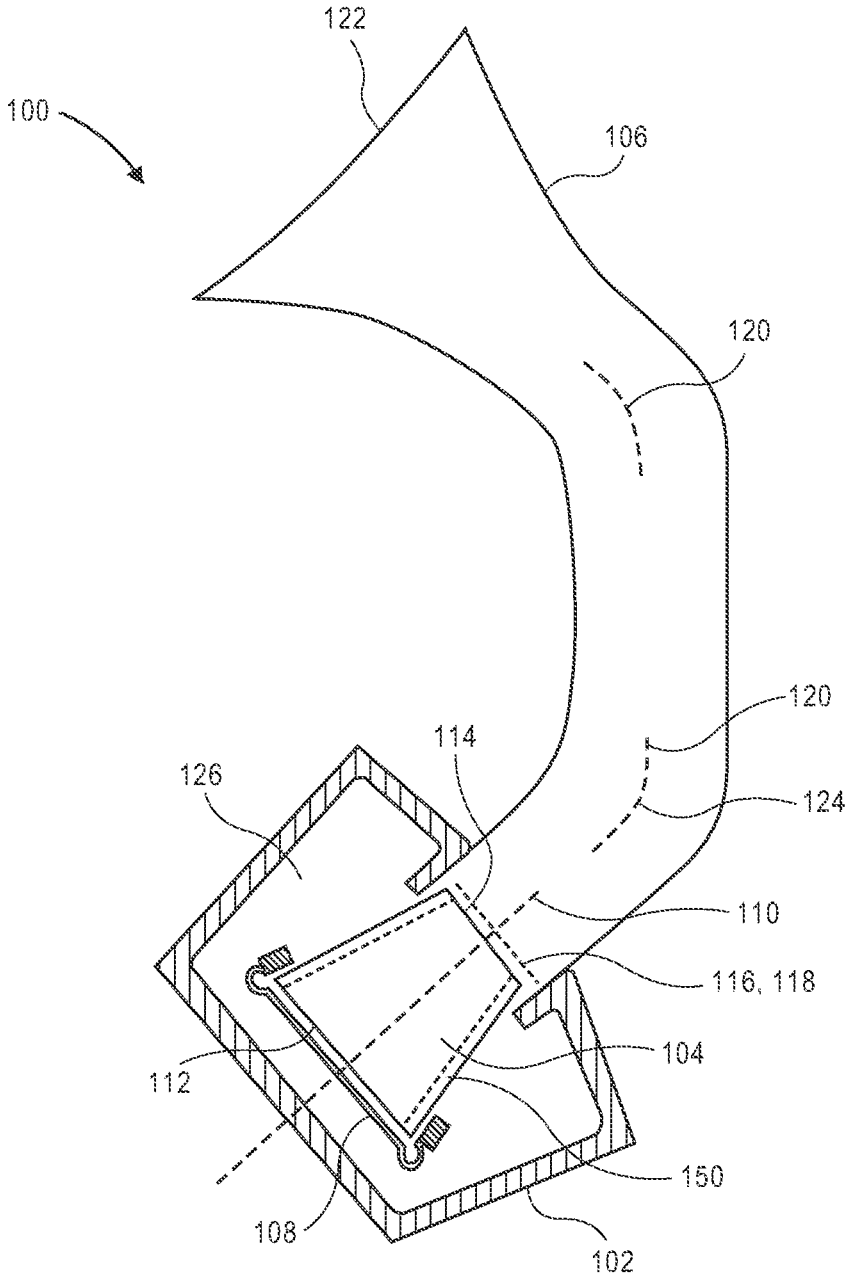
FIG. 1 is a cross-sectional view of a loudspeaker, in accordance with an embodiment.

Referring to FIG. 1, a cross-sectional view of a loudspeaker is shown in accordance with an embodiment. A loudspeaker 100 may include a driver 102 to radiate sound toward a phase plug 104. Loudspeaker 100 may be a horn loudspeaker having a compression driver coupled to an acoustic horn 106. Driver 102 can include a diaphragm 108 coupled to a speaker motor, e.g., a voicecoil and magnet assembly. The motor can drive diaphragm 108 back-and-forth along a central axis 110 to radiate sound toward horn 106 through phase plug 104. Phase plug 104 may include an input face 112 adjacent to (and/or facing) diaphragm 108, and an output face 114 adjacent to (and/or facing) a throat 116 of horn 106. Output face 114 may be separated from input face 112 along central axis 110, and thus, sound radiated by diaphragm 108 may enter input face 112 and travel through phase plug 104 along central axis 110 to exit from output face 114 toward throat 116.

Horn 106 may extend along a horn axis 120 between throat 116 and a mouth 122. Throat 116 can be disposed on a throat plane 118 oriented transverse to central axis 110. More particularly, throat 116 can include a cross-sectional area on throat plane 118, and the cross-sectional area may have an area profile extending around central axis 110. The cross-sectional area of horn 106 may change along horn axis 120. For example, the cross-sectional area at throat 116 may be noncircular, and the cross-sectional area of horn 106 at mouth 122 may be circular. The transition between throat 116 and mouth 122 may occur over one or more bends in horn 106. For example, horn axis 120 may have a bend 124 near throat 116 such that a portion of horn axis 120 proximal to bend 124 is more closely aligned with central axis 110 than a distal portion of horn axis 120 distal to bend 124. To transmit high-frequency sound waves through bend 124, it may be advantageous to have an asymmetric cross-sectional profile at throat 116. That is, high-frequency sound waves may transmit better through bend 124 when a width of a throat area differs from a length of the throat area. Accordingly, the cross-sectional area of throat 116 may be noncircular. In an embodiment, throat 116 has a rectangular cross-sectional area.

Phase plug 104 may be disposed between driver 102 and horn 106. In an embodiment, output face 114 is adjacent to throat 116. For example, output face 114 maybe coplanar with throat plane 118. Alternatively, output face 114 may be proximal to throat 116, i.e., output face 114 may be spaced apart from throat 116 between input face 112 and throat plane 118. Output face 114 may be parallel to throat plane 118. As described below, output face 114 may or may not be parallel to input face 112. That is, planes containing the profiles of input face 112 and output face 114 may be parallel or non-parallel to each other. Accordingly, phase plug 104 may conform to diaphragm 108 at a proximal end and may conform to throat 116 at a distal end.

Driver 102 of loudspeaker 100 may include a back volume 126 behind diaphragm 108. As described below, back volume 126 may be in fluid communication with phase plug 104. That is, phase plug 104 may include one or more cavities, and the cavities may form portions of back volume 126. That is, the cavities may be in fluid communication with back volume 126. Accordingly, phase plug 104 as described below can increase back volume 126 as compared to existing phase plugs. An increased back volume size can improve loudspeaker low frequency efficiency.

In an embodiment, phase plug 104 is mounted within a housing 150. Housing 150 may be a shell that mates with an outer envelope surface of phase plug 104. Sound is directed though housing 150 from diaphragm 108 to throat 116, and more particularly, sound is directed through channels formed between housing 150 and phase plug 104, as is known in the art. Housing may be a membrane wrapped over an outer envelope surface of phase plug 104, or may be an integral part, e.g., a molded part, that mates with phase plug 104 by receiving phase plug within an inner volume. The inner volume may be defined by an inner surface of a wall of housing 150. For example, housing 150 may have a wall of a predetermined thickness between the inner surface and an outer surface. Accordingly, the inner volume may have a geometry matching an outer geometry of phase plug 104. That is, the inner volume of housing 150 may have an entrance profile that is round and an exit profile that is non-round. The inner volume may be a lofted volume transitioning between a curve of the entrance profile to an angle of the exit profile, and thus, may conform to the envelope of phase plug 104 described below. Housing 150 forces sound waves to go through channels defined between arms of phase plug 104 from the entrance of the inner volume to the exit of the inner volume. That is, housing 150 may separate the sound-propagating channels of phase plug 104 from back volume 126. In an embodiment, housing 150 may provide a partition between sound-propagating channels of phase plug 104 while allowing fluid communication between back volume 126 and non-sound-propagating cavities of phase plug 104, as described below with respect to FIG. 10A.

Figure 2:
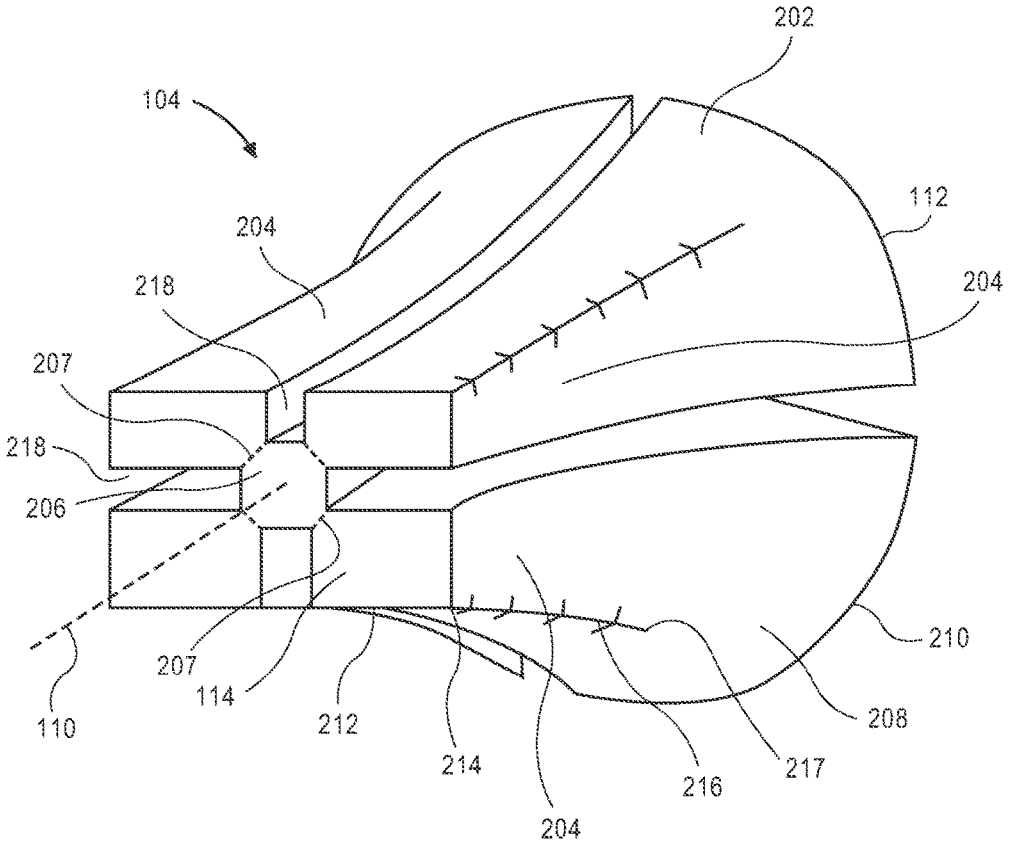
FIG. 2 is a perspective view of a phase plug, in accordance with an embodiment.

Referring to FIG. 2, a perspective view of a phase plug is shown in accordance with an embodiment. Phase plug 104 may have a plug body 202. In an embodiment, plug body 202 is a monolith. That is, the plug body 202 can be formed as a single piece having the features described below. By way of example, plug body 202 can be a singular part formed by a molding process.

Plug body 202 may have several arms 204 extending between input face 112 and output face 114. For example, each arm 204 may extend radially outward from a central hub 206 of plug body 202. Central hub 206 may be a central shaft-like portion oriented and extending along central axis 110. By way of example, central hub 206 may have a rectangular cross-sectional area. Each arm 204 may be attached to central hub 206 at an innermost region 207. Each arm 204 may radiate, i.e., extend radially, from central axis 110. More particularly, arms 204 can have cross-sections spreading in a transverse direction from central hub 206. The arms 204 may project toward an outer surface 208 radially outward from the innermost region. Outer surface 208 of each arm 204 may extend axially from input face 112 at a proximal end of phase plug 104 to output face 114 at a distal end of phase plug 104. Outer surface 208 may be concave and curve around central axis 110 and central hub 206.

In an embodiment, phase plug 104 has an envelope bounded at a proximal end by input face 112 and at a distal end by output face 114. The envelope has a lateral surface bounded by outer surface 208. That is, the lateral surface of the envelope is tangent to each of the outer surfaces 208 of arms 204. For example, if phase plug 104 were to have a round input face 112 parallel to a round output face 114, the envelope would be a frustum. In an embodiment, the lateral surface of the envelope of phase plug 104 includes an angled surface contour that transitions into a smooth surface contour. For example, outer surface 208 may extend axially from a rear edge 210 on input face 112 to a front edge 212 on output face 114. Rear edge 210 may be a smooth curve, and front edge 212 may include an angle 214. Angle 214 may be a corner where output face 114 meets the adjacent surfaces of outer surface 208.

As outer surface 208 of arm 204 transitions from angle 214 at front edge 212 of output face 114 to the smooth curve at rear edge 210 of input face 112, a ridge 216 on outer surface 208 may gradually transition into a smooth surface contour. That is, at a point in the transition between input face 112 and output face 114, ridge 216 having a peak or a vertex may arise. Ridge 216 may have an angled surface contour that includes angle 214 that decreases in a rearward direction. For example, the angled vertex of ridge 216 may decrease from a right angle (or an angle in a range of 80-100 degrees) at front edge 212 to a larger angle, e.g., an obtuse angle, at a more proximal location. Ridge 216 may disappear and outer surface 208 may have a smooth surface contour at a ridge terminus 217. Ridge terminus 217 is on outer surface 208 axially between input face 112 and output face 114.

Phase plug 104 may include one or more radial channels 218 extending axially from input face 112 to output face 114. For example, phase plug 104 may have at least three radial channels 218 between at least three arms 204. Each radial channel 218 may radiate from central axis 110. For example, radial channel 218 may be a radial slit having a channel depth extending transverse to the lateral surface of the envelope of phase plug 104 to an exposed surface of central hub 206. Radial channel 218 may have a channel width that separates one arm 204 from an adjacent arm 204 in a peripheral direction, i.e., a direction around central axis 110. Radial channel 218 may have a channel length that extends through phase plug 104 in an axial direction from diaphragm 108 to throat 116 (FIG. 1). Accordingly, radial channel 218 may guide sound waves from diaphragm 108 to throat 116. Radial channels 218 may be peripherally spaced, rather than circumferentially spaced as in a circumferential-type phase plug 104. Thus, radial channels 218 can be formed in phase plug 104 during a single molding process. Although not restricting, it will be appreciated that radial slots can be easier to form and can be fabricated with higher tolerances than circumferential slots of circumferential-type phase plugs because circumferential-type phase plugs are typically assembled from multiple pieces and have attendant tolerance stack ups.

Figure 3:
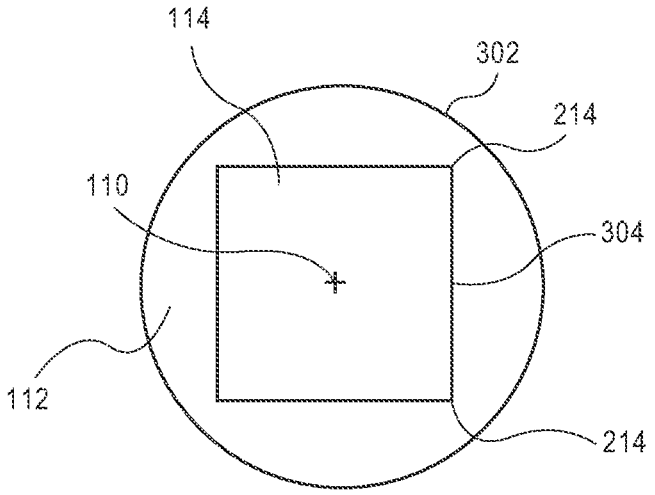
FIG. 3 is a schematic view of envelope profiles of a phase plug, in accordance with an embodiment.

Referring to FIG. 3, a schematic view of envelope profiles of a phase plug is shown in accordance with an embodiment. The schematic view of FIG. 3 views the envelope profiles along central axis 110. The envelope profiles represent edges of a front-facing boundary and a rear-facing boundary of the envelope of phase plug 104. For example, the front-facing boundary of the envelope may extend across output face 114, and the rear-facing boundary of the envelope may extend across input face 112. In an embodiment, the envelope of plug body 202 includes a round profile 302 extending around central axis 110. Round profile 302 may circumscribe input face 112. That is, round profile 302 may include and be tangent to rear edges 210 of the arms 204 of phase plug 104. By way of example, round profile 302 may be circular, elliptical, or any other curve in a plane extending along input face 112.

In an embodiment, the envelope of plug body 202 includes a non-round profile 304 extending around central axis 110. Non-round profile 304 may circumscribe output face 114. That is, non-round may include and be tangent to front edges 212 of the arms 204 of phase plug 104. By way of example, non-round profile 304 may be rectangular, square, or be any other polygon in a plane extending along output face 114. Non-round profile 304 may include angle 214.

A maximum radius of round profile 302 may be greater than a maximum width (or half the maximum width) of non-round profile 304. Similarly, an area circumscribed by non-round profile 304 may be less than an area circumscribed by round profile 302. Phase plug 104 can therefore converge from a larger area at diaphragm 108 to a smaller area at throat 116. Sound emitted by diaphragm 108 can likewise converge through radial channels 218 between input face 112 and output face 114 before entering throat 116 and expanding along horn axis 120 toward the mouth 122.

In an embodiment, non-round profile 304 may have an area larger than an area circumscribed by round profile 302. For example, phase plug 104 may have slots that converge to exit plug output face 114 over a longer than typical length. In such case, the area of non-round profile 304 may be larger than the area of round profile 302.

Figure 4:
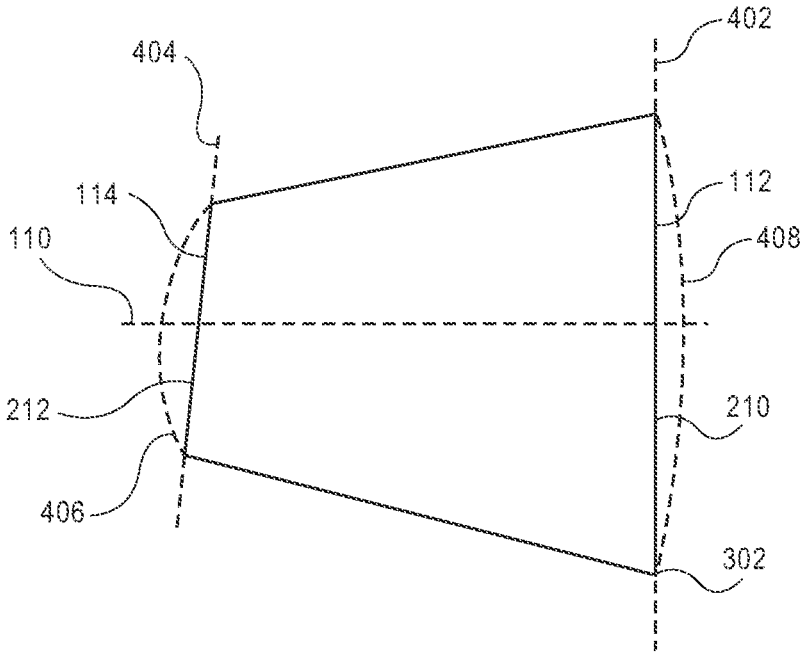
FIG. 4 is a side view of an envelope of a phase plug, in accordance with an embodiment.

Referring to FIG. 4, a side view of an envelope of a phase plug is shown in accordance with an embodiment. Input face 112 may be on, or may intersect, a proximal transverse plane 402 oriented transverse to central axis 110. For example, round profile 302 may extend around central axis 110 on or within proximal transverse plane 402 and may circumscribe input face 112. Similarly, output face 114 may be on, or may intersect, a distal transverse plane 404 separated from proximal transverse plane 402 along central axis 110. For example, non-round profile 304 may extend around central axis 110 on or within distal transverse plane 404 and may circumscribe output face 114. Accordingly, input face 112 may be separated from output face 114 along central axis 110, and output face 114 may not be parallel to proximal transverse plane 402 containing the profile of input face 112. Radial channels 218 can therefore extend axially from proximal transverse plane 402 to distal transverse plane 404, or from input face 112 to output face 114, between arms 204 within the envelope of phase plug 104 (FIG. 2).

Distal transverse plane 404 containing the non-round profile of output face 114 and proximal transverse plane 402 containing the round profile of input face 112 may or may not be parallel to one another. When the transverse planes are parallel to each other, central axis 110 may be orthogonal to both planes. Alternatively, when the transverse planes are not parallel to each other, one or both of the planes may be oblique to central axis 110. Accordingly, input face 112 and output face 114 may or may not be parallel to each other. For example, central axis 110 may be orthogonal to input face 112, and central axis 110 may be oblique to output face 114. Therefore, in an embodiment output face 114 is not parallel to input face 112. In an embodiment, an angle of tilt between proximal transverse plane 402 and distal transverse plane 404, or between output face 114 and input face 112, is in a range of 2-10 degrees, e.g., 5 degrees.

In an embodiment, one or more of input face 112 or output face 114 may be flat. For example, output face 114 may lie within distal transverse plane 404, and thus, output face 114 may be flat. Similarly, input face 112 may lie within proximal transverse plane 402, and thus, input face 112 may be flat. Alternatively, one or more of input face 112 or output face 114 may be curved. For example, output face 114 may be a curved output face 406 and/or input face 112 may be a curved input face 408, as represented by the dashed lines in FIG. 4. Accordingly, the envelope of phase plug 104 may have a curved distal or proximal surface. Central axis 110 may be orthogonal to the curved distal or proximal surface, and may pass through the curved distal or proximal surface near an apex of a bulge of output face 114 or input face 112. Although curved output faces 406, 408 are shown as having a convex contour, it will be appreciated that curved output faces 406, 408 may be concave. Curved output faces 406, 408 may not be contained within distal transverse plane 404 or proximal transverse plane 402, however, front edge 212 at which the distal surface of the envelope meets a lateral surface of the envelope may extend around central axis 110 within distal transverse plane 404. Similarly, rear edge 210 at which a proximal surface of the envelope meets the lateral surface of the envelope may extend around central axis 110 within proximal transverse plane 402. Accordingly, phase plug 104 may be formed to have any envelope, including envelope surfaces and profiles, to allow phase plug 104 to conform to surface areas and profiles of diaphragm 108 or horn 106 of loudspeaker 100. That is, input face 112 and output face 114 of phase plug 104 may each have respective round or non-round profiles and/or curved or flat surfaces to conform to corresponding shapes and contours of an adjacent loudspeaker component. For example, curved input face 408 may be a surface of revolution, e.g., a complex convex surface, about central axis 110 that follows a shape of diaphragm 108. The conformance between input face 112 or 408 and diaphragm 108 (which may in turn be flat or curved) can minimize, or control to a specific value, a volume of air between phase plug 104 and diaphragm 108. An example of an alternative phase plug geometry is described below.

Figure 5:
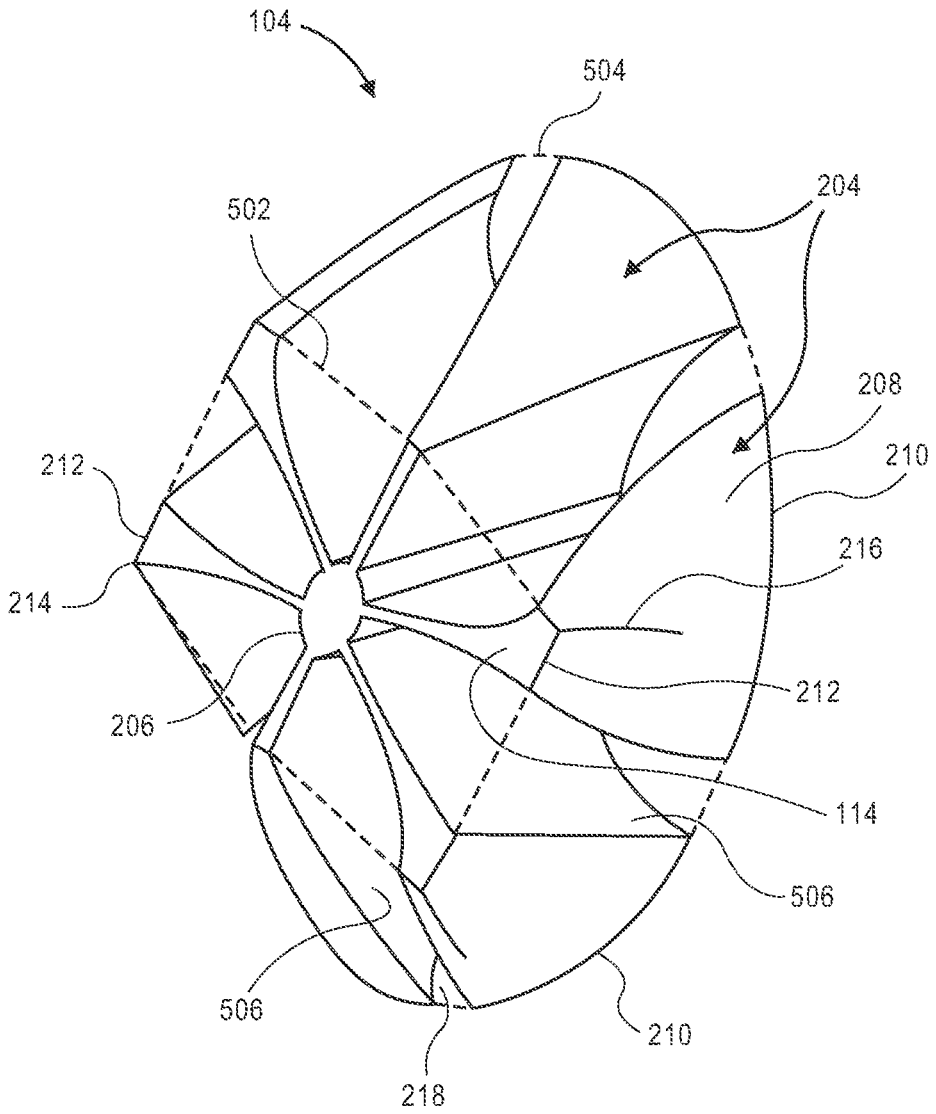
FIG. 5 is a perspective view of a phase plug, in accordance with an embodiment.

Referring to FIG. 5, a perspective view of a phase plug is shown in accordance with an embodiment. Phase plug 104 as shown in FIG. 5 may represent a variation of a phase plug 104 as described above with respect to FIGS. 1-4, and thus, shall be described using similar terminology. In an embodiment, phase plug 104 has an envelope having a polygonal or a quasi-polygonal profile 502 extending around a distal boundary of the envelope, and a circular profile 504 extending around a proximal boundary of the envelope. Here, a polygonal profile is distinguished from quasi-polygonal profile 502 in that a polygonal profile may have a shape defined by several straight line segments joined in a closed figure at several angles. By contrast, quasi-polygonal profile 502 may have a shape defined by several straight or curvilinear line segments joined in a closed figure at several angles. Quasi-polygonal profile 502 may not actually be polygonal (or rectangular) because an end of phase plug 104 may be truncated before reaching a rectangular profile, causing the edges to be curved as shown in FIG. 5. It will be appreciated, however, that in an embodiment profile 502 may be polygonal (e.g., rectangular as shown in FIG. 2). Circular profile 504 may include smooth curves on rear edges 210 of arms 204, and quasi-polygonal profile 502 may include four angles 214 on front edges 212 of arms 204.

As described above, arms 204 (of which there are six in this case) can be attached to central hub 206 and can radiate outward toward respective outer surfaces 208. More particularly, each arm 204 may include a pair of sidewalls 506 extending radially from central hub 206 to outer surface 208. Sidewalls 506 can face inward toward an adjacent radial channel 218. That is, radial channel 218 can extend axially between arms 204 to separate the arms 204 in a peripheral direction, and thus, sidewalls 506 of adjacent arms 204 may face radial channel 218 in the peripheral direction. By contrast, outer surface 208 may face away from central hub 206 in a radial direction orthogonal to both the axial direction and the peripheral direction.

Figure 6:
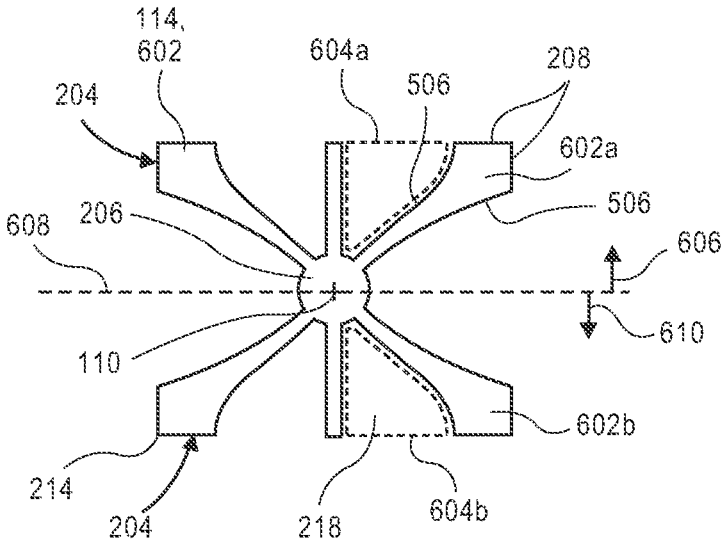
FIG. 6 is a front view of an output face of a phase plug, in accordance with an embodiment.

Referring to FIG. 6, a front view of an output face of a phase plug is shown in accordance with an embodiment. Each arm 204 may include a distal surface 602. Distal surface 602 can define a portion of output face 114. That is, distal surface 602 may be a portion of output face 114 extending along a front surface of arm 204. The front surface of arm 204 may be the portion of output face 114 radially outward of central hub 206 and extending along distal transverse plane 404 between sidewalls 506 and outer surface 208 of arm 204.

Each radial channel 218 of phase plug 104 may have a forward-facing cross-sectional area. The cross-sectional area may be referred to as a distal port 604. The distal ports 604 may be arranged about a midline 608. Midline 608 may extend within distal transverse plane 404 and through central axis 110. In an embodiment, phase plug 104 has at least two distal ports 604 having respective shapes and sizes. By way of example, distal port 604*a* on a first side 606 of a midline 608 may have a first shape and size, and distal port 604*b* on a second side 610 of midline 608 may have a second shape and size. Distal port 604*a* and distal port 604*b* may be mirrored about midline 608, but may be sized differently.

For example, distal port 604*a* on first side 606 of midline 608 may be larger than distal port 604*b* on second side 610 of midline 608.

A difference in size between distal ports 604 mirrored about midline 608 may result from distal transverse plane 404 non-parallel relative to proximal transverse plane 402. More particularly, tilting distal transverse plane 404 relative to central axis 110 can cause distal ports 604 on each side of midline 608 to have relatively different shapes and sizes. This difference in shape and size may cause an asymmetry in distal surfaces 602 of arms 204.

In an embodiment, distal surfaces 602 of arms 204 at the distal end of phase plug 104 have respective distal surface areas at distal transverse plane 404. Distal surface areas of arms 204 may correspond to the distal ports 604. For example, when distal ports 604 are symmetrically disposed about midline 608, i.e., when distal port 604*a* on first side 606 has a same cross-sectional area as distal port 604*b* on second side 610, distal surface area 602*a* may equal distal surface area 602*b*. By extension, when distal ports 604 are asymmetrically sized about midline 608, distal surface areas mirrored about midline 608 may be asymmetrically sized. For example, distal surface area 602*a* on first side 606 of midline 608 may be different than, e.g., larger than, distal surface area 602*b* on second side 610 of midline 608.

Asymmetries in distal port 604 and/or distal surface areas 602 may be uniaxial. When distal transverse plane 404 is tilted relative to proximal transverse plane 402, and midline 608 remains parallel relative to proximal transverse plane 402, asymmetries may occur in a vertical direction, i.e., on first side 606 and second side 610, but ports and surface areas in a horizontal direction may remain symmetric. Accordingly, two or more distal ports 604 or distal surfaces 602 on a same side of midline 608 may be symmetrically sized and mirrored relative to each other about a vertical midline orthogonal to midline 608. By contrast, the symmetric pair of ports on the first side 606 of midline 608 may be asymmetric relative to a corresponding symmetric pair of ports on an opposite side of midline 608.

The front view of phase plug 104 illustrates sidewalls 506 extending from central hub 206 in a radially outward direction. The radially outward direction, however, may not be linear. For example, sidewalls 506 may extend radially outward and flare such that a width of distal surface area is greater near a radial extremity of arm 204 than the width of distal surface area nearer to central hub 206.

Figure 7:
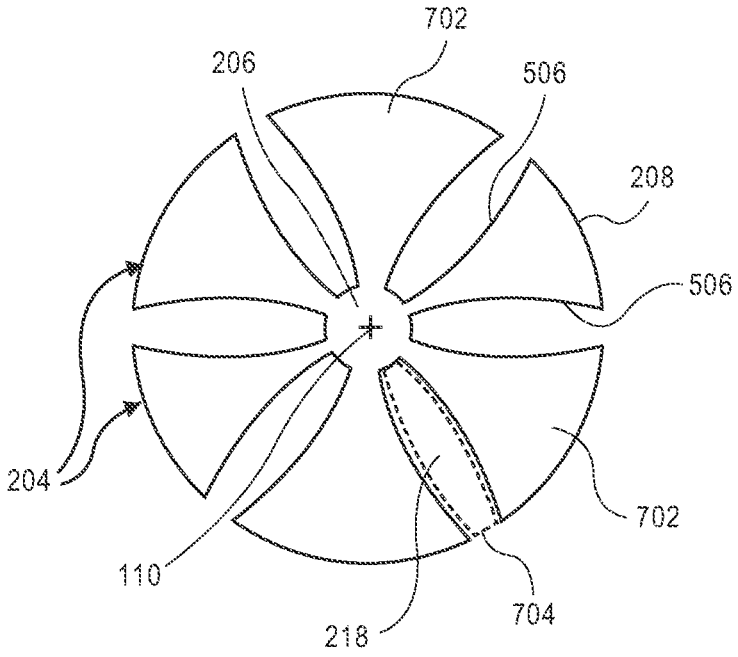
FIG. 7 is a rear view of an input face of a phase plug, in accordance with an embodiment.

Referring to FIG. 7, a rear view of an input face of a phase plug is shown in accordance with an embodiment. Each arm 204 may include a proximal surface 702. Proximal surface 702 can define a portion of input face 112. That is, proximal surface 702 may be a portion of input face 112 extending along a rear surface of arm 204. The rear surface of arm 204 may be the portion of input face 112 radially outward of central hub 206 and extending along distal transverse plane 404 between sidewalls 506 and outer surface 208 of arm 204.

Each radial channel 218 of phase plug 104 may have a rear-facing cross-sectional area. The cross-sectional area may be referred to as a proximal port 704. In an embodiment, the proximal ports 704 of phase plug 104 are symmetrically arranged about central axis 110. For example, when input face 112 includes is orthogonal to central axis 110 and includes circular profile 504, proximal ports 704 may have a same shape and size and may be symmetrically distributed in a peripheral direction around central axis 110. Alternatively, when central axis 110 is oblique to input face 112, proximal ports 704 may be asymmetrically disposed about a midline, similar to the asymmetries described above with respect to distal ports 604 relative to midline 608. Proximal surfaces 702 of arms 204 may have surface areas that are symmetric or asymmetric corresponding to proximal ports 704, and similar to the embodiments of distal surfaces 602 described above.

Figure 8:
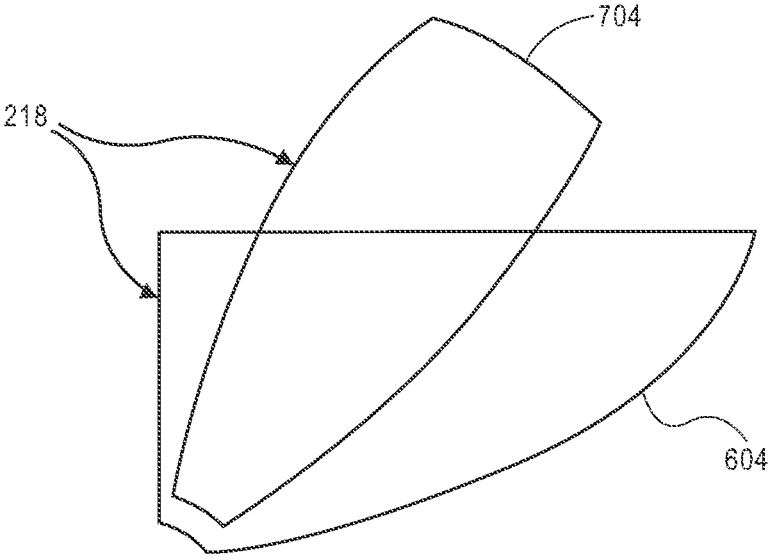
FIG. 8 is a schematic view of interconnected radial channel areas of a phase plug, in accordance with an embodiment.

Referring to FIG. 8, a schematic view of interconnected radial channel areas of a phase plug is shown in accordance with an embodiment. A cross-sectional area of a single radial channel 218 may vary in an axial direction. For example, a port area of proximal port 704 can be different than a port area of distal port 604. In an embodiment, an area of distal port 604 is greater than an area of proximal port 704. Differences between the port areas of proximal port 704 and distal port 604 may change the acoustic impedance versus frequency seen by the transducer diaphragm 108, and may manage local air particle velocities. In a phase plug used over a wide frequency bandwidth, maintaining low particle velocities in all section of the phase plug is typically necessary to achieve desired acoustic output levels.

Figure 9:
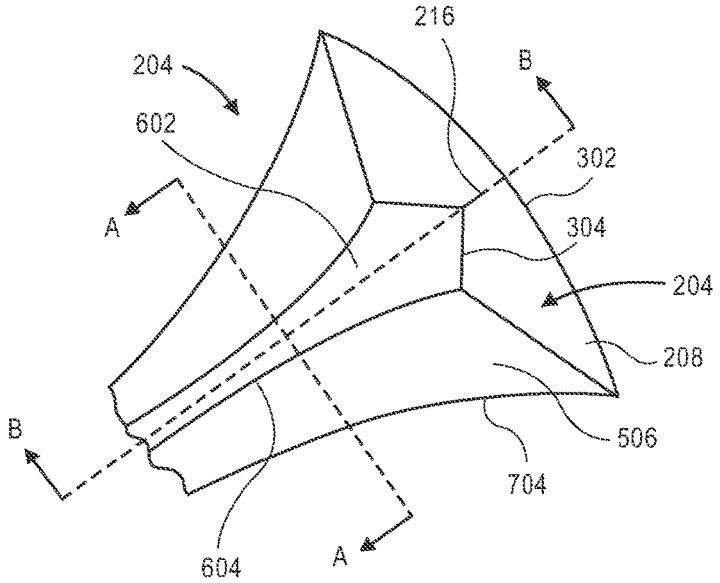
FIG. 9 is a front view of a portion of an arm of a phase plug, in accordance with an embodiment.

Referring to FIG. 9, a front view of a portion of an arm of a phase plug is shown in accordance with an embodiment. An exterior of arm 204 can include smooth surfaces, e.g., along sidewalls 506 between proximal port 704 and distal port 604. The exterior can also include angular surfaces, e.g., along an edge where sidewall 506 meets outer surface 208 or at ridge 216. As described above, the smooth surface contours and angular surface contours can result from an axial transition between round profile 302 and non-round profile 304 of phase plug 104. In an embodiment, arm 204 has a solid cross-section throughout. That is, the volume of arm 204 defined between sidewalls 506, outer surface 208, distal surface 602, and proximal surface 702, may be solid. Alternatively, as described below, one or more arms 204 of phase plug 104 may have a cored-out section.

Figure 10A:
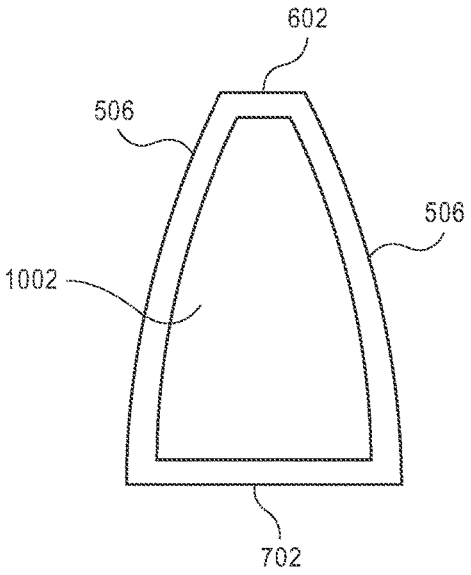
FIGS. 10A-10B are cross-sectional views, taken about line A-A of FIG. 9, of an arm of a phase plug having a cavity, in accordance with an embodiment.

Referring to FIG. 10A, a cross-sectional view, taken about line A-A of FIG. 9, of an arm of a phase plug having a cavity is shown in accordance with an embodiment. Each arm 204 of phase plug 104 may include a cavity 1002. Cavity 1002 can be on an opposite side of sidewall 506 from an adjacent radial channel 218. More particularly, cavity 1002 may be between a pair of sidewalls 506, and sidewalls 506 may isolate cavity 1002 from radial channels 218 on either side of arm 204. Thus, at least one of the pair of sidewalls 506 may be between cavity 1002 and radial channel 218.

In an embodiment, cavity 1002 extends laterally through outer surface 208 of arm 204. More particularly, cavity 1002 may extend radially from central hub 206 outward into a space surrounding phase plug 104, e.g., back volume 126. Accordingly, cavity 1002 may be surrounded within arm 204 by the pair of sidewalls 506, central hub 206, distal surface 602, and proximal surface 702. As such, cavity 1002 may be a core-out of arm 204 opening toward a space laterally outward of phase plug 104. By contrast, radial channels carrying sound through phase plug may be closed off from back volume 126 by a wall of housing 150. In an embodiment, a hole in the wall of housing 150 surrounding the outer envelope of phase plug 104 may be aligned with an entrance to cavity 1002 to place cavity 1002 in fluid communication with back volume 126 through the hole (not shown).

Figure 10B:
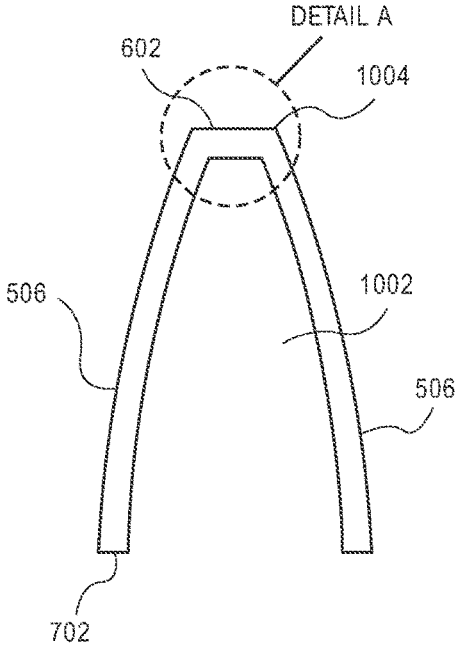

Referring to FIG. 10B, a cross-sectional view, taken about line A-A of FIG. 9, of an arm of a phase plug having a cavity is shown in accordance with an embodiment. Cavity 1002 may extend axially from distal surface 602 outward into a space surrounding phase plug 104, e.g., back volume 126. For example, cavity 1002 may extend through proximal surface 702. Accordingly, cavity 1002 may be surrounded within arm 204 by the pair of sidewalls 506, central hub 206, distal surface 602, and outer surface 208. As such, cavity 1002 may be a core-out of arm 204 opening toward a space behind phase plug 104.

Figure 11A:
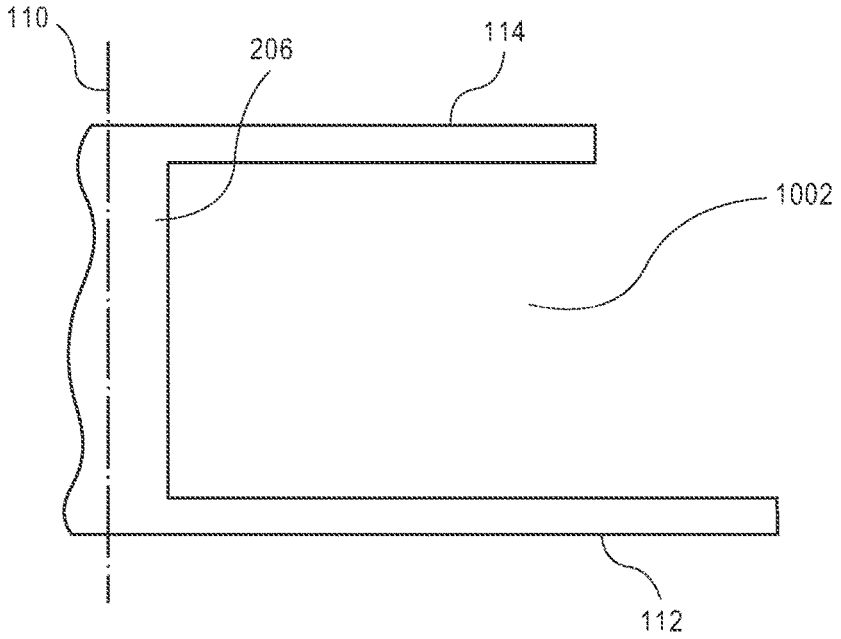
FIGS. 11A-11B are cross-sectional views, taken about line B-B of FIG. 9, of an arm of a phase plug having a cavity, in accordance with an embodiment.
Figure 11B:
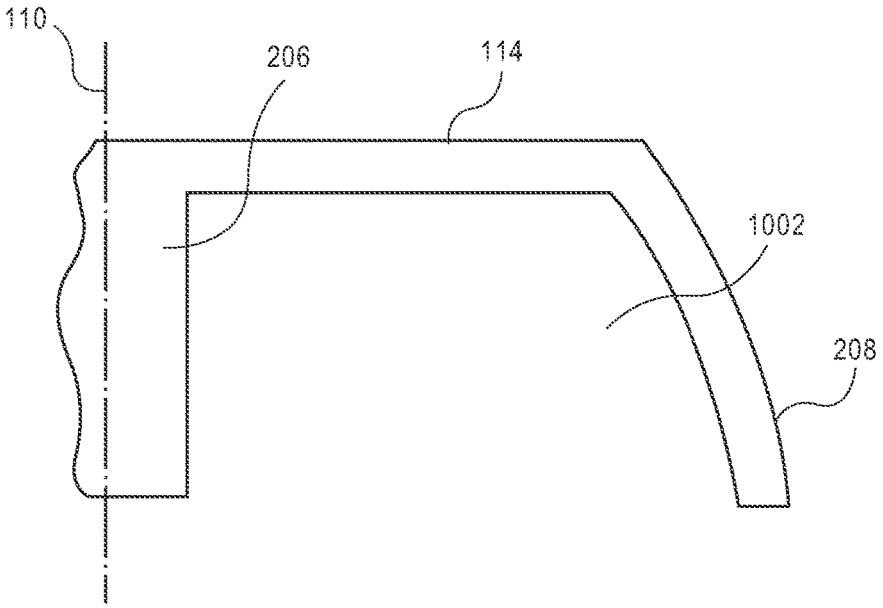

Referring to FIG. 11A, a cross-sectional view, taken about line B-B of FIG. 9, of an arm of a phase plug having a cavity is shown in accordance with an embodiment. Cavity 1002 extending laterally outward from arm 204 in a radial direction away from central hub 206 can form a space contained within arm 204 between output face 114 and input face 112. Referring to FIG. 11B, a cross-sectional view, taken about line B-B of FIG. 9, of an arm of a phase plug having an alternative embodiment of a cavity is shown in accordance with an embodiment. Cavity 1002 extending axially outward from arm 204 in an axial direction away from output face 114 can form a space contained within arm 204 between central hub 206 and outer surface 208.

As described above, back volume 126 of driver 102 may be in acoustic communication with core-outs in arms 204 of phase plug 104. For example, cavity 1002 may extend laterally outward or axially outward from phase plug 104 into back volume 126. Accordingly, cavity 1002 may be a portion of back volume 126. Cavity 1002 may be separated from radial channels 218 by sidewalls 506, however, and thus, cavities may increase a total volume behind diaphragm 108 without causing cancellations with sound emitted in front of diaphragm 108. Increasing the total volume of driver 102 behind diaphragm 108 can improve loudspeaker 100 performance.

Loudspeaker 100 performance can also be improved by minimizing cancellations between sound waves as sound moves through radial channel 218 in front of diaphragm 108. The transition between proximal port 704 to distal port 604 may be configured to minimize such cancellations. More particularly, sound cancellations, such as in the high frequency range, may be minimized by controlling how sound waves travel through each channel, which affects how the sound waves recombine at an exit of the phase plug. In an embodiment, sound output may also be controlled by a design of a transitional edge 1004 between sidewall 506 and distal surface 602 (FIG. 10B).

Figure 12:
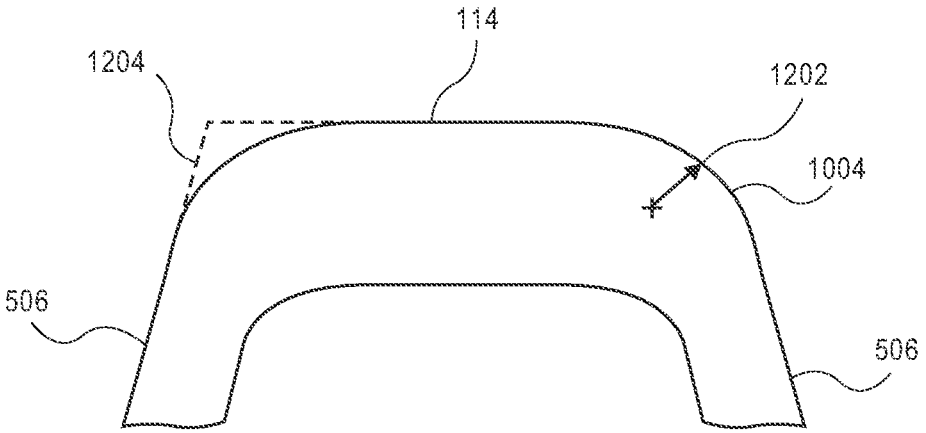
FIG. 12 is a detail view, taken from Detail A of FIG. 10B, of a transitional edge of an arm of a phase plug, in accordance with an embodiment.

Referring to FIG. 12, a detail view, taken from Detail A of FIG. 10B, of a transitional edge of an arm of a phase plug is shown in accordance with an embodiment. Each arm 204 may include transitional edge 1004 between sidewall 506 and output face 114. For example, arm 204 may include respective transitional edges 1004 between each sidewall 506 of the pair of sidewalls flanking cavity 1002, and output face 114. Transitional edge 1004 may be a fillet, a chamfer, or another contour transitioning between the surfaces of sidewall 506 and output face 114. For example, transitional edge 1004 may be a convex surface having a radius 1202. Transitional edge 1004 may be contrasted with an edge having the sharp corner 1204, as represented by a dashed line in FIG. 12. In an embodiment, transitional edge 1004 allows air to diverge smoothly from radial channel 218 into a space in front of phase plug 104. Such an edge can keep local air particle velocity lower at the exit of the phase plug where the sound waves enter the throat of horn 106. The smooth divergence of air can slow a velocity of sound waves prior to the sound waves entering throat 116 of horn 106. For example, analytical modeling of phase plug 104 having a flat output face 114 and a contoured transitional edge 1004 has shown that air velocity can be reduced significantly to allow a higher volume velocity through the same size phase plug slot for higher sound output levels. In general, keeping air velocity below approximately 15 m/s can keep air flow in a laminar range, which prevents turbulence. Turbulence causes undesirable noise generation, and thus, limits a maximum achievable sound output level, especially at lower frequencies where higher volume velocities are required to maintain a constant sound pressure level. Phase plug 104 can be used in loudspeaker drivers to reduce sound cancellations in a range of 300 Hz to 20 kHz.

In the foregoing specification, the invention has been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. A phase plug, comprising:

a plug body having an input face separated from an output face along a central axis, wherein a round profile extends around the central axis on a proximal transverse plane and circumscribes the input face, wherein a non-round profile extends around the central axis on a distal transverse plane and circumscribes the output face, wherein the plug body includes a plurality of arms radiating from the central axis at the output face, wherein the plurality of arms have respective sidewalls forming a sound channel between the sidewalls, and wherein the sound channel radiates from the central axis and extends axially from the proximal transverse plane to the distal transverse plane between the plurality of arms.

2. The phase plug of claim 1, wherein the round profile is circular, and wherein the non-round profile is rectangular.

3. The phase plug of claim 1, wherein the plug body includes a central hub extending along the central axis, wherein each of the plurality of arms includes a pair of sidewalls extending radially outward from the central hub to an outer surface facing away from the central hub, and wherein each of the plurality of arms includes a distal surface defining a portion of the output face and extending between the pair of sidewalls.

4. The phase plug of claim 3, wherein each of the plurality of arms includes a cavity between the pair of sidewalls, and wherein at least one of the pair of sidewalls is between the cavity and the sound channel.

5. The phase plug of claim 4, wherein each of the plurality of arms includes a proximal surface defining a portion of the input face, wherein the cavity extends through the proximal surface, and wherein the pair of sidewalls, the central hub, the distal surface, and the outer surface surround the cavity.

6. The phase plug of claim 4, wherein each of the plurality of arms includes a proximal surface defining a portion of the input face, wherein the cavity extends through the outer surface, and wherein the pair of sidewalls, the central hub, the distal surface, and the proximal surface surround the cavity.

7. The phase plug of claim 3, wherein the output face is flat.

8. The phase plug of claim 7, wherein each of the plurality of arms includes a transitional edge between one of the pair of sidewalls and the output face.

9. The phase plug of claim 7, wherein the output face is not parallel to the input face.

10. The phase plug of claim 3, wherein the distal surfaces of the plurality of arms have distal surface areas at the distal transverse plane, and wherein the distal surface areas are asymmetrically sized.

11. The phase plug of claim 10, wherein a midline extends within the distal transverse plane and through the central axis, and wherein the distal surface areas on a first side of the midline are larger than the distal surface areas on a second side of the midline.

12. A phase plug, comprising:

a plug body having an input face and an output face separated along a central axis, wherein a non-round profile circumscribes the output face, wherein the plug body includes a plurality of arms radiating from the central axis at the output face, wherein the plurality of arms have respective sidewalls forming a sound channel between the sidewalls, wherein each of the plurality of arms includes an outer surface extending axially from a rear edge on the input face to a front edge on the output face, wherein the rear edge is a smooth curve, and wherein the front edge includes an angle.

13. The phase plug of claim 12, wherein the plug body includes a circular profile extending around the central axis and circumscribing the input face, wherein the plug body includes a rectangular profile extending around the central axis and circumscribing the output face, wherein the circular profile includes the smooth curve, and wherein the rectangular profile includes the angle.

14. The phase plug of claim 12, wherein the plug body includes a central hub, wherein each of the plurality of arms includes a pair of sidewalls extending radially from the central hub to the outer surface, and wherein each of the plurality of arms includes a distal surface defining a portion of the output face and extending between the pair of sidewalls.

15. The phase plug of claim 14, wherein the plug body includes a circular profile extending around the central axis and circumscribing the input face within a proximal transverse plane, and wherein the output face is not parallel to the proximal transverse plane.

16. The phase plug of claim 14, wherein each of the plurality of arms includes a transitional edge between one of the pair of sidewalls and the output face.

17. A loudspeaker, comprising:

a driver having a diaphragm;

a horn coupled to the driver, the horn having a mouth, and a throat on a throat plane; and a phase plug between the diaphragm and the throat, the phase plug including a plug body having an input face facing the diaphragm and an output face facing the throat, wherein the output face is separated from the input face along a central axis, wherein the plug body includes a round profile extending around the central axis and circumscribing the input face, wherein the plug body includes a non-round profile extending around the central axis and circumscribing the output face, wherein the plug body includes a plurality of arms radiating from the central axis at the output face, wherein the plurality of arms have respective sidewalls forming a sound channel between the sidewalls, and wherein the sound channel extends axially from the diaphragm to the throat between the plurality of arms.

18. The loudspeaker of claim 17, wherein the plug body includes a central hub, wherein each of the plurality of arms extends radially from the central hub, wherein the round profile is circular, and wherein the non-round profile is rectangular.

19. The loudspeaker of claim 17, wherein the output face is proximal to the throat, wherein the output face is parallel to the throat plane, and wherein the output face is not parallel to a proximal transverse plane containing the round profile.

20. The loudspeaker of claim 17, wherein the loudspeaker includes a back volume behind the diaphragm, wherein each of the plurality of arms includes a pair of sidewalls extending radially from the central axis and a cavity between the pair of sidewalls, and wherein the cavity is a portion of the back volume.

* * * * *